US005332112A

United States Patent [19]

Blocker

[11] Patent Number: 5,332,112

[45] Date of Patent: Jul. 26, 1994

[54] PARTITIONED BOTTLE

[76] Inventor: Elisha Blocker, 4888 Naff Ave., Bastrop, La. 71220-7452

[21] Appl. No.: 64,717

[22] Filed: May 19, 1993

[51] Int. Cl.[5] ..... B65D 1/04

[52] U.S. Cl. ..... 215/6; 215/31; 215/230; 215/235

[58] Field of Search ..... 215/1 C, 6, 31, 100 R, 215/230, 235; 220/259, 524, 555, 628

[56] References Cited

U.S. PATENT DOCUMENTS

| | | | |
|---|---|---|---|
| 274,147 | 3/1883 | Snyder | 220/524 |
| 557,352 | 3/1896 | Bender | 215/6 |
| 611,008 | 9/1898 | Gerstendorfer | 215/6 |
| 2,665,816 | 1/1954 | Anft | 220/524 |
| 2,748,946 | 6/1956 | Smith | 215/100 R |
| 3,076,573 | 2/1963 | Thomas | 215/6 |
| 3,197,071 | 7/1965 | Kuster | 215/6 |
| 3,381,875 | 5/1968 | Tunick | 220/524 |
| 4,065,536 | 12/1977 | Lucas | 215/6 |
| 5,076,464 | 12/1991 | Simon | 215/6 |
| 5,232,108 | 8/1993 | Nakamura | 215/6 |

FOREIGN PATENT DOCUMENTS

| | | | |
|---|---|---|---|
| 606457 | 8/1948 | United Kingdom | 215/6 |

*Primary Examiner*—Gary E. Elkins
*Attorney, Agent, or Firm*—John M. Harrison

[57] ABSTRACT

A bottle having a vertical partition to divide the bottle interior into two compartments of equal size, a base extending from the bottom of the bottle to support the bottle, a pair of neck seal panels hinged to the partition at the mouth of the bottle for sealing the mouth openings into the respective bottle compartments and a cap threaded on the neck of the bottle for maintaining the neck seal panels in closed configuration.

20 Claims, 1 Drawing Sheet

PARTITIONED BOTTLE

BACKGROUND OF THE INVENTION

FIELD OF THE INVENTION

This invention relates to compartmented enclosures and more particularly, to a bottle having a vertical partition for dividing the interior of the bottle into two compartments of equal size. In a preferred embodiment the bottle is provided with a threaded neck and a pair of neck seal panels hinged to the partition at the mouth of the bottle for selective opening to access either one or both of the compartments in the bottle. A cap is threaded on the neck of the bottle to maintain the neck seal panels in closed configuration. A base extends from the bottom of the bottle for support purposes and in a most preferred embodiment of the invention, a plaque is fitted into a recess on the side of the bottle to indicate the contents.

Various types of containers having partitions are known in the art. Typical of these is the cylindrical, multiple partition vessel, typically constructed of a polymeric material and designed to receive various spices in wedged-shaped compartments extending radially from the center of the container. Hinged triangular caps are provided on each of the compartments to facilitate dispensing a separate spice or condiment from the various compartments.

It is an object of this invention to provide a partitioned bottle which is characterized by a bottle or container provided with at least one vertically-oriented partition for dividing the bottle into at least two compartments, a base extending from the bottom of the bottle for support purposes, at least one pair of neck seal panels hinged to the partition at the bottle mouth for selectively sealing the openings to the individual compartments in the bottle and a cap for threadably seating on the threaded neck to close the neck seal panels in sealing configuration.

Another object of this invention is to provide a partitioned enclosure or container of selected shape and size and having at least one vertical partition, with at least one pair of seal panels hingedly mounted in the container neck for selectively accessing one or more of the compartments defined by the vertical partition.

Still another object of the invention is to provide a bottle which is vertically partitioned to define a pair of compartments of equal size, which bottle includes a cylindrical container portion having a stand or base extending from the bottom thereof for support, a pair of hingedly-mounted neck seal panels provided in the neck of the bottle at the bottle mouth to selectively seal and access the respective compartments in the bottle and a cap threaded on the bottle neck to facilitate closing the neck seal panels in sealing configuration.

SUMMARY OF THE INVENTION

These and other objects of the invention are provided in a container or bottle fitted with a vertical divider or partition for dividing the bottle into two separate compartments of equal volume, a scalloped support or base extending from the center bottom area of the container and sweeping outwardly to define a round base for supporting the container, a pair of hinged neck seal panels provided in the neck of the bottle at the bottle mouth for selectively opening and closing access to each of the interior compartments and a cap threaded on the externally-threaded neck of the bottle for securing the neck seal panels in closed, sealed configuration.

BRIEF DESCRIPTION OF THE DRAWING

The invention will be better understood by reference to the accompanying drawing, wherein.

DESCRIPTION OF THE PREFERRED EMBODIMENTS

Figure 1:
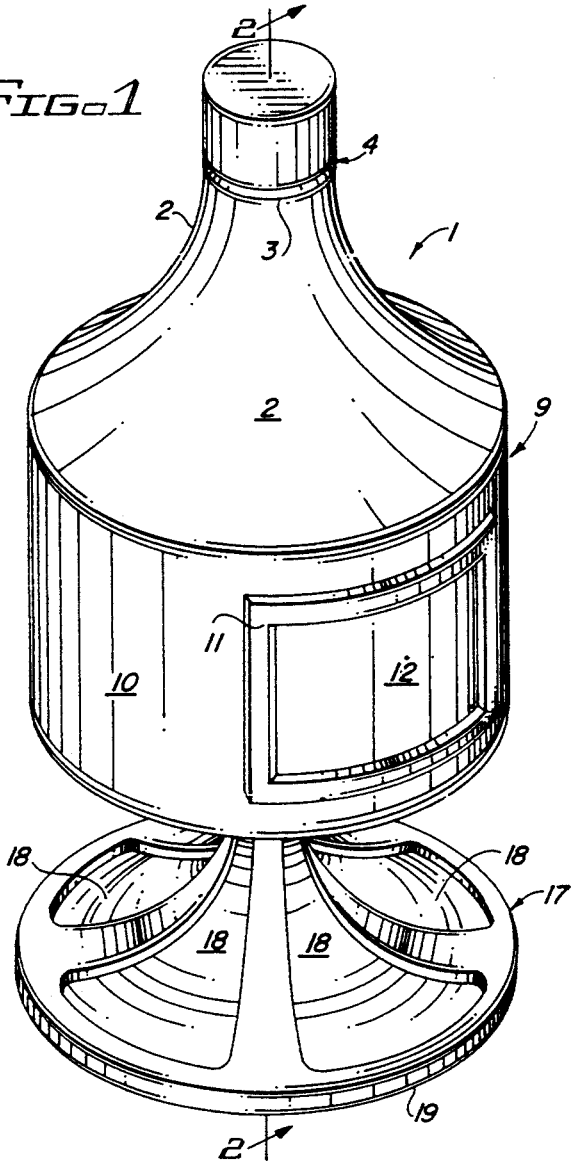
FIG. 1 is a perspective view of a preferred embodiment of the partitioned bottle of this invention.
Figure 2:
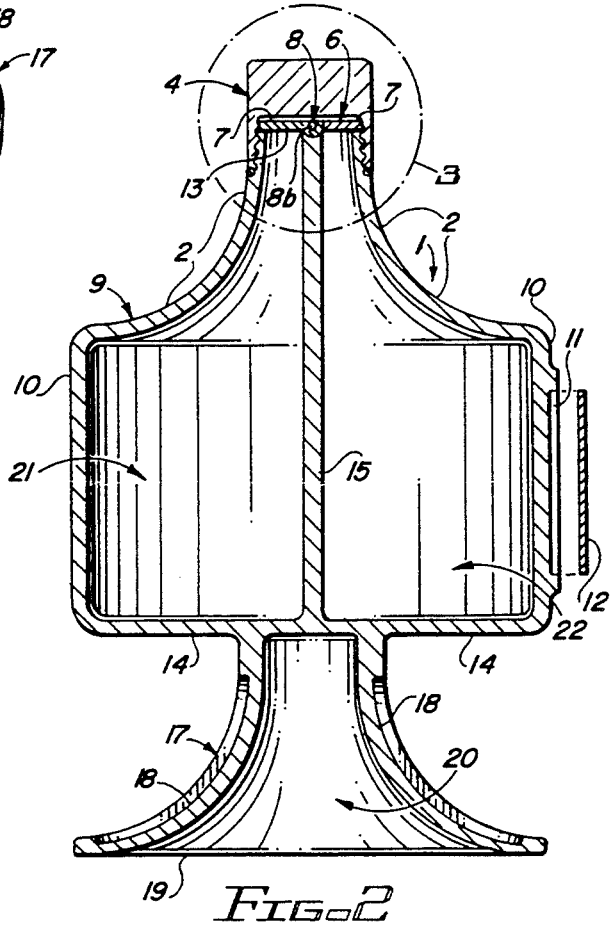
FIG. 2 is a sectional view taken along 2—2 of the partitioned bottle illustrated in FIG. 1.

Referring initially to FIGS. 1 and 2 of the drawing, the partitioned bottle of this invention is generally illustrated by reference numeral 1. The partitioned bottle 1 is characterized by cylindrically-shaped container 9, the bottle side 10 of which is provided with a plaque recess 11 for receiving a curved plaque 12. The plaque 12 contains indicia (not illustrated) which identifies the contents of the partitioned bottle 1. A neck 2 tapers from the top of the bottle side 10 of the container 9 to define external neck threads 3. A vertical partition 15 projects from the neck 2 at the bottle mouth 13, vertically downwardly to the bottle bottom 14, in order to divide the interior of the container 9 into two compartments of equal size, a first compartment 21 and a second compartment 22. A bottle base 17 extends in flared relationship from the center of the bottle bottom 14 to define multiple base recesses 18, which taper to a round, flat supporting surface 19, as illustrated in FIGS. 1 and 2. A base cavity 20 is provided in the bottle base 17, as further illustrated in FIG. 2.

Figure 3:
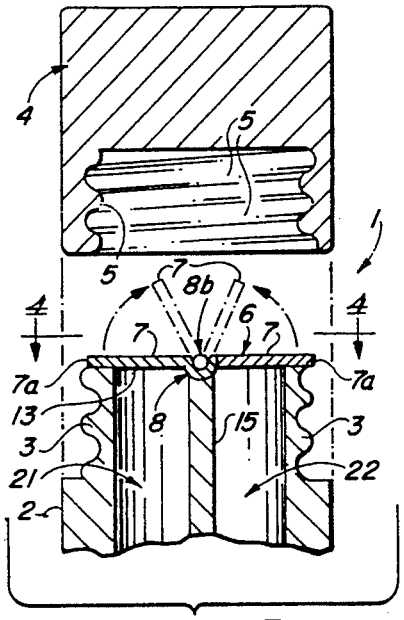
FIG. 3 is an enlarged sectional view of the threaded neck portion and cap of the partitioned bottle illustrated in FIGS. 1 and 2.
Figure 4:
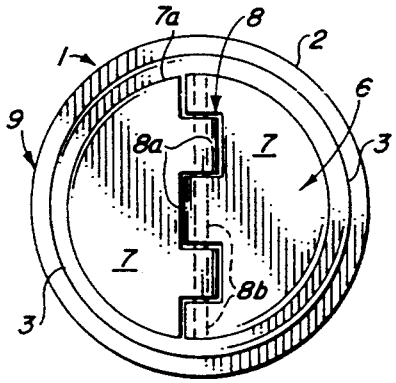
FIG. 4 is a sectional view taken along line 4—4 of the neck portion of the partitioned bottle illustrated in FIG. 3, more particularly illustrating a pair of neck seal panels hinged to a vertical partition.

Referring now to FIGS. 2–4 of the drawing, in a most preferred embodiment of the invention a neck seal 6 is fitted in the neck portion of the neck 2 at the bottle mouth 13 and is characterized by a pair of semicircular neck seal panels 7, hinged at the flat edges along facing diameters by means of a panel hinge 8. Each of the neck seal panels 7 is fitted with a pair of spaced hinge flanges **8*a* which interlock and receive a hinge pin 8*b*, secured to the partition 15, to facilitate independent hinged opening and closing of the neck seal panels 7. A panel flange 7*a* extends the periphery of each of the neck seal panels 7 to facilitate engaging and selectively opening the neck seal panels 7 on the panel hinge 8 and provide access to the first compartment 21 and the second compartment 22 through the neck 2 of the container 9 at the bottle mouth 13. A cap 4 is fitted with internal cap threads 5 for engaging the external neck threads 3 of the neck 2 and closing and sealing the neck seal panels 7 on the neck 2 to secure the contents of the first compartment 21 and second compartment 22**.

Referring again to FIG. 2 of the drawing, in a most preferred embodiment of the invention the plaque recess 11 is designed to receive a curved, rectangularly-shaped plaque 12 which is inscribed with various indicia (not illustrated) to indicate the contents of the first compartment 21 and second compartment 22. It will be appreciated by those skilled in the art that while a single plaque recess 11 and plaque 12 are provided in the partitioned bottle 1 as illustrated in FIG. 2, additional plaque recesses 11 and plaques 12 may be provided on the container 9 of the partitioned bottle 1 to individually identify the contents of the various compartments, as desired. In this regard, it will be further appreciated by those skilled in the art that while a single partition 15 is indicated in the partitioned bottle 1 illustrated in the drawing, multiple partitions may be equally well provided in the container 9 for dividing the container 9 into multiple compartments, as desired. Accordingly, it is understood that the first compartment 21 and second compartment 22 are defined by a single partition 15 in the drawing for purposes of illustration only.

It will also be appreciated by those skilled in the art that the partitioned bottle 1 may be constructed of any desired material, including glass, clay or a polymeric material such as polyethylene, polypropylene and the like, in non-exclusive particular, according to the desires of the user. Accordingly, the partitioned bottle 1 may be used to contain substantially any desired material, liquid or granular, which can be added and removed by removing the cap 4 from the neck 2 of the partitioned bottle 1 and opening one or both of the neck seal panels 7 by pressure applied to the respective panel flanges *7a*.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A partitioned bottle comprising an enclosure having a hollow interior, a bottom; a neck shaped in said enclosure; at least one partition provided in said enclosure, said partition extending from said bottom into said neck and dividing the interior of said enclosure into at least two compartments; and at least two seal means hingedly disposed in said neck, whereby said compartments are selectively opened and closed responsive to opening and closing said seal means.

2. The partitioned bottle of claim 1 comprising cap means for removably engaging said neck and closing said seal means over said compartments.

3. The partitioned bottle of claim 2 comprising neck threads provided on said neck and cap threads provided in said cap means for threadably engaging said neck threads and securing said cap means on said neck.

4. The partitioned bottle of claim 1 wherein said at least one partition comprises a single partition, said at least two compartments comprises a pair of compartments and said at least two seal means comprises a pair of seal means disposed over said compartments, respectively.

5. The partitioned bottle of claim 4 comprising cap means for removably engaging said neck and closing said seal means over said compartments.

6. The partitioned bottle of claim 5 comprising neck threads provided on said neck and cap threads provided in said cap means for engaging said neck threads and threadably securing said cap means on said neck.

7. The partitioned bottle of claim 4 comprising:

(a) cap means for removably engaging said neck; and (b) neck threads provided on said neck and cap threads provided in said cap means for engaging said neck threads and threadably securing said cap means on said neck and closing said seal means over said compartments.

8. The partitioned bottle of claim 1 wherein said bottle is provided with contents and comprising a plaque provided on said bottle and indicia provided on said plaque for identifying the contents of said enclosure.

9. The partitioned bottle of claim 8 comprising a recess shaped in said enclosure for receiving said plaque.

10. The partitioned bottle of claim 8 comprising cap means for removably engaging said neck and closing said seal means over said compartments.

11. The partitioned bottle of claim 10 comprising neck threads provided on said neck and cap threads provided in said cap means for engaging said neck threads and threadably securing said cap means on said neck.

12. The partitioned bottle of claim 11 wherein said at least one partition comprises a single partition, said at least two compartments comprises a pair of compartments and said at least two seal means comprises a pair of half-round seals hingedly connected to said partition and disposed over said compartments, respectively.

13. The partitioned bottle of claim 12 comprising a recess shaped in said enclosure for receiving said plaque.

14. The partitioned bottle of claim 1 comprising a base extending from said bottom for supporting said enclosure.

15. The partitioned bottle of claim 14 comprising:

(a) cap means for removably engaging said neck; and (b) neck threads provided on said neck and cap threads provided in said cap means for engaging said neck threads and threadably securing said cap means on said neck and closing said seals over said compartments.

16. The partitioned bottle of claim 15 wherein said at least one partition comprises a single partition, said at least two compartments comprises a pair of compartments and said at least two seal means comprises a pair of half-round, flat seals hingedly connected to said partition and disposed over said compartments, respectively.

17. The partitioned bottle of claim 16 wherein said bottle is provided with contents and comprising a plaque provided on said bottle and indicia provided on said plaque for identifying the contents of said enclosure.

18. The partitioned bottle of claim 17 comprising a recess shaped in said enclosure for receiving said plaque.

19. A partitioned bottle comprising an enclosure having a hollow interior, bottom; a base extending from said bottom for supporting said enclosure; a neck shaped in said enclosure; a partition provided in said enclosure, said partitions extending from said bottom into said neck and dividing the interior of said enclosure into two compartments of substantially equal size; and at least two semicircular seals hingedly carried by said partition in said neck, whereby said compartments are selectively opened and closed responsive to opening and closing said seals.

20. The partitioned bottle of claim 19 wherein said bottle is provided with contents and comprising:

(a) neck threads provided on said neck and a cap having cap threads for engaging said neck threads and threadably securing said cap on said neck; and (b) a recess provided on said bottle and a plaque provided on said bottle in said recess and indicia provided on said plaque for identifying the contents of said bottle.

* * * * *